US008592122B2

(12) United States Patent
Matsumoto et al.

(10) Patent No.: US 8,592,122 B2
(45) Date of Patent: Nov. 26, 2013

(54) DEVELOPER FOR DEVELOPING ELECTROSTATIC LATENT IMAGE, DEVELOPER CARTRIDGE FOR DEVELOPING ELECTROSTATIC LATENT IMAGE, PROCESS CARTRIDGE, AND IMAGE FORMATION APPARATUS

(75) Inventors: Akira Matsumoto, Kanagawa (JP); Yukiaki Nakamura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 797 days.

(21) Appl. No.: 12/545,577

(22) Filed: Aug. 21, 2009

(65) Prior Publication Data

US 2010/0178603 A1 Jul. 15, 2010

(30) Foreign Application Priority Data

Jan. 14, 2009 (JP) ..... 2009-005515

(51) Int. Cl.
*G03G 9/00* (2006.01)

(52) U.S. Cl.
USPC ..... 430/111.3; 430/105; 430/111.33; 430/111.35

(58) Field of Classification Search
USPC ..... 430/105, 111.3, 118.6, 111.35, 111.33
See application file for complete search history.

(56) References Cited

U.S. PATENT DOCUMENTS 4,048,136 A * 9/1977 Kobayashi et al. ..... 524/439
5,631,116 A * 5/1997 Uchida et al. ..... 430/111.1
6,312,862 B1 * 11/2001 Okado et al. ..... 430/110.1
2006/0127134 A1 * 6/2006 Sakamaki et al. ..... 399/223
2006/0275058 A1 12/2006 Omata
2008/0152391 A1 * 6/2008 Bae et al. ..... 399/231

FOREIGN PATENT DOCUMENTS

CN 1609717 A 4/2005
CN 101149576 A 3/2008
JP A 2004-354631 12/2004
JP A-2007-011293 1/2007

OTHER PUBLICATIONS

Machine Translation of JP2004-354631.*
Mar. 26, 2012 Office Action issued in Chinese Patent Application No. 200910173863.8 (with English-language translation).
Nov. 23, 2012 Office Action issued in Korean Patent Application No. 10-2009-0085548 (with English translation).

* cited by examiner

*Primary Examiner* — Thorl Chea
(74) *Attorney, Agent, or Firm* — Oliff & Berridge, PLC

(57) ABSTRACT

The invention provides a developer for developing an electrostatic latent image, the developer having at least: a transparent toner; and a carrier. The carrier contains at least: a magnetic particle; and a resin coating layer. The resin coating layer coats the surface of the magnetic particle and has cyan color. The invention further provides a developer cartridge storing the developer. The invention further provides a process cartridge storing the developer. The invention further provides an image formation apparatus having at least a color toner image-forming unit, a transparent toner image-forming unit that uses the developer to form a transparent toner image, and a fixing unit.

14 Claims, 1 Drawing Sheet

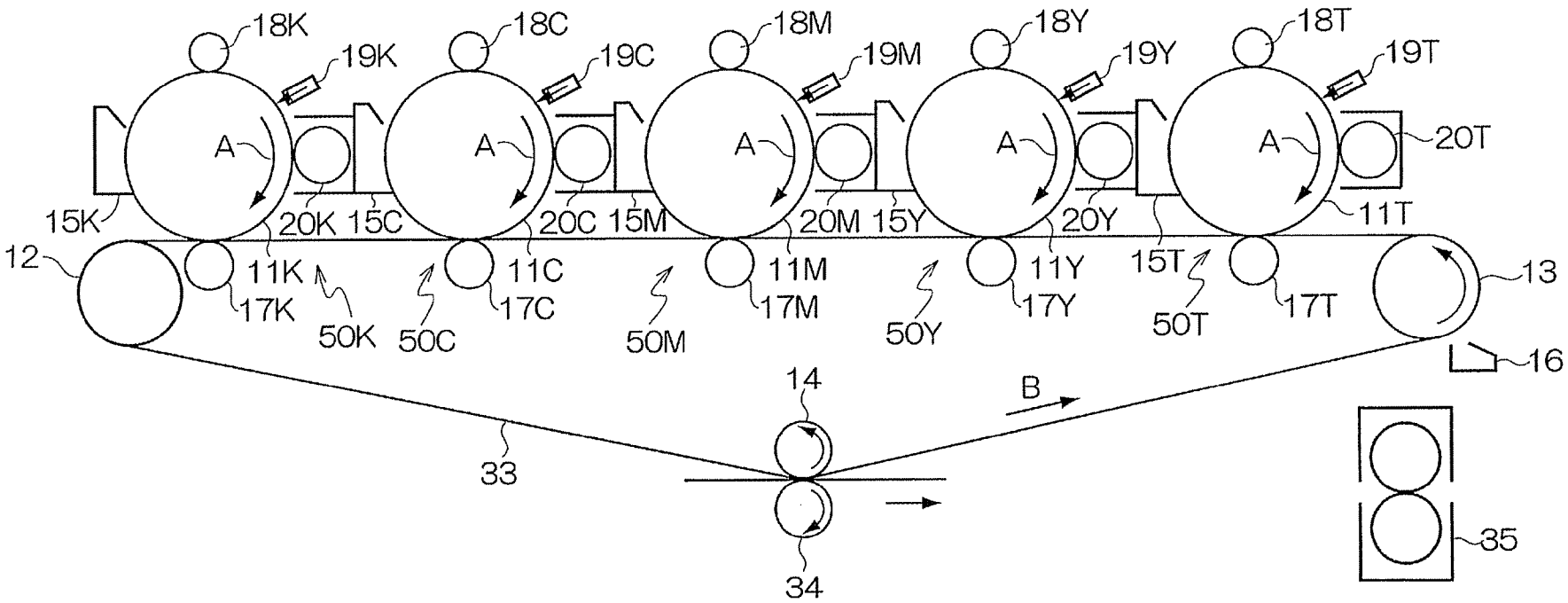
13
16
35
20T
19T
11T
18T
A
17T
50T
15T
19Y
20Y
18Y
11Y
17Y
B
50Y
15Y
19M
20M
18M
11M
17M
14
34
50M
15M
19C
20C
18C
11C
17C
33
50C
15C
19K
20K
50K
18K
11K
17K
15K
12

DEVELOPER FOR DEVELOPING ELECTROSTATIC LATENT IMAGE, DEVELOPER CARTRIDGE FOR DEVELOPING ELECTROSTATIC LATENT IMAGE, PROCESS CARTRIDGE, AND IMAGE FORMATION APPARATUS

CROSS-REFERENCE TO RELATED APPLICATION

This application is based on and claims priority under 35 USC 119 from Japanese Patent Application No. 2009-005515 filed on Jan. 14, 2009.

BACKGROUND

1. Technical Field

The present invention relates to a developer for developing an electrostatic latent image, a developer cartridge for developing an electrostatic latent image, a process cartridge and an image formation apparatus.

2. Related Art

Methods of visualizing image information through an electrostatic latent image, such as electrophotography, have been used in various fields. In electrophotography, an electrostatic latent image formed on a photoreceptor by charging and exposing is developed with a developer containing a toner, and then is subjected to transferring and fixing to be finally visualized.

Developers that are used in development include a two-component developer containing a toner and a carrier, and a one-component developer which uses a toner alone, such as a magnetic toner. The two-component developer, in which the carrier performs a portion of the functions of the developer including stirring, conveyance and electrical charging, is functionally segregated as a developer. Accordingly, the two-component developer has features such as being highly controllable and thus is currently widely used.

Image formation based on a conventional electrophotographic method employs a toner containing a colorant. Use of a transparent toner upon image formation has been known in order to obtain images having higher glossiness. For a transparent toner for electrostatic latent image development, it is required that transparent images formed by using the transparent toner have high transparency. However, because binder resins used in such a toner are also actually colored to some extent, the "transparent images" may not be completely transparent but rather have a slightly yellowish tinge, which may result in subtle changes in the color hue of the images. A technique including incorporating a colorant having an opposite color to make the yellowish tinge unnoticeable may be considered as the technique for correcting the yellowish tinge. However, since the colorant to be used for this purpose is used in a fairly trace amount, when the colorant is incorporated into the toner, there may be cases in which the adjustment of the amount of the colorant may be difficult, or there are irregularities from one toner to another.

SUMMARY

One aspect of the invention is a developer for developing an electrostatic latent image, the developer comprising: a transparent toner; and a carrier, the carrier comprising: a magnetic particle; and a resin coating layer that coats the surface of the magnetic particle and has cyan color.

Another aspect of the invention is a developer cartridge for developing an electrostatic latent image, the developer cartridge storing the developer and being attachable to and detachable from an image formation apparatus, the image formation apparatus comprising an electrostatic latent image holder and a developing unit that develops an electrostatic latent image formed on a surface of the electrostatic latent image holder to form a toner image, and the developer cartridge supplying the developer to the developing unit.

Another aspect of the invention is a process cartridge storing the developer and comprising at least one selected from the group consisting of: an electrostatic latent image holder; a charging unit that charges a surface of the electrostatic latent image holder; a developing unit that develops the electrostatic latent image formed on the surface of the electrostatic latent image holder with the developer to form a toner image; and a cleaning unit that removes residual toner on the surface of the electrostatic latent image holder.

Another aspect of the invention is an image formation apparatus comprising a color toner image-forming unit, a transparent toner image-forming unit and a fixing unit, the color toner image-forming unit comprising: a first electrostatic latent image holder; a first charging unit which charges the surface of the first electrostatic latent image holder; a first electrostatic latent image forming unit that forms an electrostatic latent image on the surface of the first electrostatic latent image holder charged by the first charging unit; a first developing unit that develops the first electrostatic latent image formed on the surface of the first electrostatic latent image holder with a developer comprising a color toner to form a color toner image; and a first transferring unit which transfers the color toner image formed on the surface of the first electrostatic latent image holder to a surface of a recording medium, the transparent toner image-forming unit comprising: a second electrostatic latent image holder; a second charging unit which charges the surface of the second electrostatic latent image holder; a second electrostatic latent image forming unit that forms an electrostatic latent image on the surface of the second electrostatic latent image holder charged by the second charging unit; a second developing unit that develops the second electrostatic latent image formed on the surface of the second electrostatic latent image holder with the developer comprising the transparent toner to form a transparent toner image; and a second transferring unit which transfers the transparent toner image formed on the surface of the second electrostatic latent image holder to the surface of the recording medium, and the fixing unit fixing the transferred color toner image and the transferred transparent toner image on the surface of the recording medium.

BRIEF DESCRIPTION OF THE DRAWING

Exemplary embodiments of the present invention will be described in detail based on the following FIGURE, wherein:

FIG. 1 is a schematic view illustrating an example of an image formation apparatus according to the exemplary embodiment of the invention.

DETAILED DESCRIPTION

Carrier for Electrostatic Latent Image Development

The carrier for electrostatic latent image development of the exemplary embodiment of the invention has at least a magnetic particle and a resin coating layer that coats the surface of the magnetic particle and has cyan color.

The resin coating layer of the exemplary embodiment of the invention has cyan color, which imparts a moderate bluish tinge to a transparent toner image and suppresses changes in the image color gamut that occur due to color tone of the resin.

It is thought that when the transparent toner and the carrier are stirred and conveyed in a machine and are thereby brought to contact with each other, the resin coating layer of the carrier is gradually chipped off by the stress exerted onto the carrier from the transparent toner and/or the stress exerted mutually among the carrier particles themselves, and the resulting flakes (flakes of the cyan-colored resin coating layer) are mixed with the toner such that the flakes are attached to the transparent toner.

When the resin coating layer of the exemplary embodiment of the invention is referred as "having cyan color" or "being cyan-colored", the main peak of the transmittance appears in the wavelength region of about 430 nm to about 550 nm in an absorbance analysis of the coating resin which forms the resin coating layer. Specific measurement of the transmittance may be carried out as follows. The carrier is dispersed in a solvent which is capable of dissolving the coating resin and is subjected to ultra-sonication for 5 minutes, and thereby the coating layer is separated from the carrier core. The carrier cores are removed from the liquid with a magnet, and then the absorbance analysis of the liquid (for example, analyzer ULTRASCANPRO (trade name, manufactured by Hunter Associates Laboratory, Inc.) is carried out. The absorbance analysis is carried out by appropriately adjusting the liquid concentration. For example, if the liquid concentration is too high and transmission does not occur at all, the liquid may be diluted by adding the solvent thereto, and then the measurement is carried out to see whether a main peak exists in the wavelength region. If the liquid concentration is too low and complete transmission occurs, the amount of the solvent may be reduced or the amount of the carrier may be increased in the dispersing so as to adjust the concentration, and if a main peak exists in the wavelength region may be seen.

The magnetic particle of the carrier that may be used in the exemplary embodiment of the invention is not particularly limited. Examples thereof include particles made of a magnetic metal such as iron, steel, nickel or cobalt, an alloy of such a magnetic metal with manganese, chromium or a rare earth metal, and a magnetic oxide such as ferrite or magnetite. From the viewpoints of good surface properties of the magnetic particles and the resistance of the magnetic particles, an alloy of manganese, lithium, strontium, or magnesium and ferrite may be preferable.

The carrier that is used in the exemplary embodiment of the invention has a resin coating layer that covers the surface of the magnetic particle and has cyan color. There is no particular limitation to a resin that forms the resin coating layer as long as it has cyan color and may be suitably selected according to the purpose. Examples of the resin include polyolefin resins such as polyethylene or polypropylene; polyvinyl resins and polyvinylidene resins such as polystyrene, acrylic resins, polyacrylonitrile, polyvinyl acetate, polyvinyl alcohol, polyvinyl butyral, polyvinyl chloride, polyvinyl carbazole, polyvinyl ether or polyvinylketone; vinyl chloride-vinyl acetate copolymers; styrene-acrylic acid copolymers; straight silicone resins or modified product thereof including organosiloxane bonds; fluorine resins such as polytetrafluoroethylene, polyvinyl fluoride, polyvinylidene fluoride or polychlorotrifluoroethylene; silicone resins; polyesters; polyurethanes; polycarbonates; phenol resins; amino resins such as urea-formaldehyde resins, melamine resins, benzoguanamine resins, urea resins and polyamide resins; and epoxy resins. These may be used by solely one kind, or as a combination of two or more kinds.

In embodiments, the resin coating layer according to the exemplary embodiment of the invention contain a resin containing a non-polar vinyl monomer. Since the intermolecular force of the non-polar vinyl monomer is weak, the stress occurring inside a developing machine can cause the resin coating layer to be gradually chipped off, and the flakes of the resin, which has the cyan color imparted by a cyan pigment or a cyan dye contained in the resin, may attach to the toner. Therefore, the flakes of the cyan-colored resin may be effectively supplied to the toner. The content of the resin having a non-polar vinyl monomer as a constituent unit in the resin coating layer is preferably about 50% by mole to about 99.5% by mole, more preferably about 80% by mole to about 95% by mole, and even more preferably about 85% by mole to about 90% by mole with respect to the total amount of the resin coating layer.

Examples of the non-polar vinyl monomer, acrylic acid esters, methacrylic acid esters, and styrenes.

Examples of the acrylic acid esters include methyl acrylate, ethyl acrylate, n-propyl acrylate, isopropyl acrylate, n-butyl acrylate, isobutyl acrylate, sec-butyl acrylate, amyl acrylate, hexyl acrylate, 2-ethylhexyl acrylate, octyl acrylate, 2-phenoxyethyl acrylate, 2-chloroethyl acrylate, benzyl acrylate, cyclohexyl acrylate, tetrahydrofurfuryl acrylate, phenyl acrylate, 2-methoxyethyl acrylate, and 2-ethoxyethyl acrylate.

Examples of the methacrylic acid esters include methyl methacrylate, ethyl methacrylate, n-propyl methacrylate, isopropyl methacrylate, n-butyl methacrylate, isobutyl methacrylate, sec-butyl methacrylate, amyl methacrylate, hexyl methacrylate, cyclohexyl methacrylate, benzyl methacrylate, acetoacetoxyethyl methacrylate, chlorobenzyl methacylate, octyl methacrylate, furfuryl methacrylate, tetrahydrobutyl acrylate, phenyl methacrylate, and diethyl methacrylate.

Examples of the styrenes include methylstyrene, ethylstyrene, propylstyrene, and p-t-butylstyrene.

Examples of the non-polar vinyl monomer that may be used as a copolymerizable component include acrylic acid esters and methacrylic acid esters which respectively have an alicyclic group in a branch. Specific examples of the acrylic acid esters which have an alicyclic group in a branch include cyclohexyl acrylate having an alicyclic group in its branch, and specific examples of the methacrylic acid esters which have an alicyclic group in a branch include cyclohexyl methacrylate having an alicyclic group in its branch.

In embodiments, resin particles and/or conductive particles having a volume resistivity of about $10^2$ Ω·cm or less at 20° C. may be dispersed in the resin of the resin coating layer. Examples of the resin particles include thermoplastic resin particles and thermosetting resin particles. Among these, thermosetting resin particles are preferable in view of relatively readily increasing hardness, and resin particles of nitrogen-containing resins are preferable in view of imparting negative charging property to the toner. These resin particles may be used by solely one kind or as a combination of two or more kinds.

The average particle size of the resin particles is preferably from about 0.1 μm to about 2 μm, and more preferably from about 0.2 μm to about 1 μm. When the average particle size of the resin particles is less than about 0.1 μm, dispersing property of the resin particles in the film may be deteriorated, and when the average particle size exceeds about 2 μm, the resin particles may easily fall from the resin coating layer and may not exhibit its inherent effect.

Examples of the conductive particles include metal particles such as particles made of gold, silver or copper; particles made of carbon black, and particles obtained by coating the surfaces of titanium oxide, zinc oxide, barium sulfate, aluminum borate, potassium titanate powder, or the like with tin oxide, carbon black, a metal or the like. These may be used by solely one kind, or as a combination of two or more kinds.

Among these, carbon black particles may be preferable in view of fine production stability, costs, electroconductivity, and the like. Although the kind of the carbon black is not specifically limited, a carbon black having a DBP oil absorption value of from about 50 ml/100 g to about 250 ml/100 g may be preferable in view of excellent production stability. The amount of the resin, resin particles or conductive particles for coating the surface of the core material is generally from 0.5 wt % to 5.0 wt %, preferably from 0.7 wt % to 3.0 wt %.

From the viewpoint that the color tone of the image obtainable by using the toner becomes satisfactory, the conductive particles included in the resin film layer may be white-colored conductive particles. This is because, even if the resin film layer is peeled off, the color tone of the image is not substantially affected thereby. This effect may be noticeable when the carrier used in combination with the transparent toner forms a film containing white-colored conductive particles.

Examples of the white conductive particles include particles obtained by coating the surfaces of titanium oxide, zinc oxide, barium sulfate, aluminum borate, potassium titanate powder, or the like with tin oxide, and preferable examples thereof include particles obtained by coating the surfaces of titanium oxide, zinc oxide, barium sulfate or the like with tin oxide.

Examples of the compound which imparts cyan color to the resin coating layer of the exemplary embodiment of the invention include cyan colorant, a combination of other colorants such as blue or green, and the like.

Among them, cyan colorant may be preferable as the compound giving cyan color from the viewpoint that even a small amount of addition may accomplish its effect. Examples of the cyan colorant include a cyan pigment and a cyan dye.

It is required for a transparent toner for electrostatic latent image development that the transparent image formed using the toner have high transparency. However, since binder resins for toner have in fact some color, the toner cannot become completely transparent but can have a slightly yellowish tinge, thus causing subtle changes in the color gamut. As a technique for correcting the yellowish tinge, a technique of incorporating an opposite color to make the yellowish tinge unnoticeable, may be considered. However, since the colorant is added in a fairly trace amount, when the colorant is incorporated into the toner, the adjustment of the amount is difficult, or there occurs a phenomenon that there is a variation from one toner to another.

In the exemplary embodiment of the invention, when a transparent toner is applied as the toner, the color tone of the resin possessed by the binder resin for toner may be suppressed.

Examples of the cyan pigment include C.I. Pigment Blue 1, 2, 3, 4, 5, 6, 7, 10, 11, 12, 13, 14, 15, 15:1, 15:2, 15:3, 15:4, 15:6, 16, 17, 23, 60, 65, 73, 83, or 180; C.I. Vat Cyan 1, 3, or 20; pruissian blue, cobalt blue, alkali blue lakes, phthalocyanine blue, metal-free phthalocyanine blue, partial chlorination products of phthalocyanine blue, fast skyblue, and indanthrene blue BC.

Examples of the cyan dye include C.I. Solvent Cyan 79 or 162.

The content of the cyan colorant in the resin coating layer is preferably from about 0.1% by mass to about 30% by mass, more preferably from about 0.5% by mass to about 10% by mass, and even more preferably from about 1% by mass to about 5% by mass with respect to the total amount of the resin coating layer.

The method for forming the resin coating layer is not particularly limited. Examples thereof include: a method including using a resin coating layer formation liquid containing a cyan pigment or a cyan dye and a coating resin in a solvent; and a method including using a resin coating layer formation liquid containing at least one of the resin particles such as crosslinkable resin particles and the conductive particles and the resins such as a styrene acrylic resin, a fluorine-based resin or a silicone resin as a matrix resin in a solvent.

Specific examples of the method for forming the resin coating layer include: an immersion method including immersing the magnetic particles in the resin coating layer formation liquid; a spray method including spraying the resin coating layer formation liquid on the surface of the magnetic particles; and a kneader coater method including mixing the magnetic particles with the resin coating layer formation liquid while the particles are made to float by fluidizing air, and removing the solvent. Among these, the kneader coater method may be preferable.

The solvent used in the resin coating layer formation liquid is not particularly limited as long as the solvent can dissolve the resin which works as a matrix resin, and may be selected among solvents which are known per se. Examples thereof include aromatic hydrocarbons such as toluene or xylene; ketones such as acetone or methyl ethyl ketone; and ethers such as tetrahydrofuran or dioxane. When the resin particles are dispersed in the resin coating layer, the resin particles and the particles as the matrix resin are dispersed in the thickness direction of the resin coating layer and in the tangent direction of the carrier surface. Therefore, even if the carrier is used for a long time and thus the resin coating layer is abraded, surface forming properties that are similar to those obtainable in an unused state may be maintained, and a satisfactory ability to impart charge to the toner may be maintained over a long time period. Further, in the case where the conductive particles are dispersed in the resin coating layer, the conductive particles and the resin as the matrix resin are dispersed in the thickness direction of the resin coating layer and in the tangent direction of the carrier surface. Therefore, even if the carrier is used for a long time and thus the resin coating layer is abraded, surface formation that is similar to that obtainable in an unused state may be maintained, and deterioration of the carriers may be prevented for a long time. In the case where the resin particles and the conductive particles are dispersed in the resin coating layer, the effect mentioned above is accomplished.

The electrical resistivity (volume specific resistivity) of the entire of the thus-formed magnetic carrier in the state of a magnetic brush under an electrical field of $10^4$ V/cm may be about $10^8$ Ω·cm or more. When the electrical resistivity of the magnetic carrier is less than about $10^8$ Ω·cm, the carrier may adhere on the image portion on the latent image holding member, and brush marks may be readily generated.

The volume resistivity value may be measured as follows.

A sample is put on a lower electrode plate of a measurement jig, which is a pair of 20 $cm^2$ circular electrode plates (made of steel) connected to an electrometer (trade name: KEITHLEY 610C, manufactured by Keithley Instruments, Inc.) and a high pressure electrical source (trade name: FLUKE 415B, manufactured by Fluke Corporation), so that the sample forms a plane layer having a thickness of from about 1 mm to about 3 mm. An upper electrode plate is put on the sample, and a 4 kg-weight is put on the upper electrode plate so as to remove the gaps in the sample. In this state, the thickness of the sample layer is measured. Voltage is then applied to both electrode plates to measure the value of the electrical current, and volume resistivity value is calculated based on the following equality.

Volume resistivity value={(applied voltage×20)/(current value−initial current value)}/sample thickness In the equality, the initial current value is the value of the current when the applied voltage is 0, and the current value is the value of the measured current value.

According to the exemplary embodiment of the invention, the average value of the shape factor SF1 of the carrier is preferably in the range of from about 100 to about 120, more preferably in the range of from about 100 to about 115, and even more preferably in the range of from about 100 to about 110.

When the average value of the shape factor falls in that range, the resin coating layer of the carrier may be prone to chipping off when the carrier and the toner are brought to contact.

The shape factor SF1 may be calculated according to the following Equality (1).

$$SF1=(ML^2/A)\times(\pi/4)\times 100 \qquad \text{Equality (1):}$$

In Equality (1), ML represents the absolute maximum length of the carrier particle, and A represents the projected area of the carrier particle. The average value of the shape factor SF1 may be obtained by introducing images of 50 or more carrier particles, magnified to 250 times, from an optical microscope into an image analysis apparatus (trade name: LUZEX III, manufactured by Nireco Corp.), determining the values of SF1 from the maximum length and projected area for individual particles, and averaging the value of SF1 of the entire particles.

As the shape factor SF1 of the particles approaches 100, the particles become closer to a true sphere in shape. As the carrier particles approach a true sphere in shape, the variation in the stress exerted to the carrier particles may be reduced, and the flakes of the resin coating layer of the carrier may attach to the toner evenly.

In the exemplary embodiment of the invention, the particle size distribution of finer powders of the carrier and the particle size distribution of coarser powders of the carrier are preferably both in the range of about 1.00 to about 1.20, more preferably in the range of about 1.00 to about 1.15, and even more preferably in the range of about 1.00 to about 1.10.

When the particle size distributions fall in that range, the resin coating layer of the carrier may become prone to uniform chipping off when the carrier and the toner are brought to contact.

The particle size distribution of finer powders and the particle size distribution of coarser powders of the carrier are measured as follows. First, 100 mg of a measurement sample is added to a liquid prepared by diluting 2 ml of a 5% aqueous solution of sodium alkylbenzenesulfonate with 100 ml of pure water. The liquid obtained by suspending the sample is subjected to dispersing for one minute with an ultrasonic dispersing instrument, and measurement is carried out in water using a laser diffraction/scattering type particle size distribution analyzer (trade name: LS PARTICLE SIZE ANALYZER LS13320, manufactured by Beckman Coulter, Inc.), at the 90% pump speed. Based on the thus-obtained particle size distribution data of the carrier, the volumes of carrier particles in each of partitioned particle ranges (channels) are obtained. These are then plotted starting from the smallest size to give a volume cumulative distribution curve, and the particle diameter at a cumulative point of 50% is defined as volume-average particle diameter D50v. Similarly, the particle diameter at a cumulative point of 84% is defined as volume-average particle diameter D84v. The coarser particle size distribution is defined as D84v/D50v. Further, the channels are plotted starting from the smallest size to give a number cumulative distribution curve, and the particle diameter at a cumulative point of 50% is defined as number-average particle diameter D50p. Similarly, the particle diameter at a cumulative point of 16% is defined as number-average particle diameter D16p. The finer particle size distribution is defined as D50p/D16p.

The narrower the particle size distribution of the carrier is, the lesser the bias of stress application to the carrier becomes, so that flakes of the resin coating layer of the carrier may be more uniformly attached to the toner.

Developer for developing an electrostatic latent image development

The developer for developing an electrostatic latent image development of the exemplary embodiment of the invention contains at least a transparent toner and the carrier for electrostatic latent image development.

Examples of a binder resin employed in the transparent toner include homopolymers or copolymers of styrenes such as styrene and chlorostyrene, monoolefins such as ethylene, propylene, butylene and isoprene, vinyl esters such as vinyl acetate, vinyl propionate, vinyl benzoate and vinyl acetate, a-methylenealiphaticmonocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate, vinyl ethers such as vinyl methyl ether, vinyl ethyl ether and vinyl butyl ether, vinyl ketones such as vinyl methyl ketone, vinyl hexyl ketone and vinyl isopropenyl ketone, and the like. Specifically, examples of typical binder resins may include polystyrene, styrene-alkyl acrylate copolymers, styrene-alkyl methacrylate copolymers, styrene-acrylonitrile copolymer, styrene-butadiene copolymer, styrene-maleic anhydride copolymer, polyethylene and polypropylene. In addition, polyesters, polyurethanes, epoxy resins, silicon resins, polyamides, modified rosins, paraffins and waxes may be exemplified. Among these polyesters tend to have a yellowish tinge. Accordingly, the effect of the exemplary embodiment of the invention may be specifically obtained when polyesters are employed as the binder resin.

The polyester resin employed in the exemplary embodiment of the invention may be synthesized by polycondensation of a polyol component and a polycarboxylic acid component. In the exemplary embodiment of the invention, either commercially available polyester resins or suitably synthesized polyester resins may be used as the polyester resin.

Examples of the polyvalent carboxylic acid component include, but are not limited to, aliphatic dicarboxylic acids such as oxalic acid, succinic acid, glutalic acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid and 1,18-octadecanedicarboxylic acid; aromatic dicarboxylic acids such as dibasic acids such as phthalic acid, isophthalic acid, terephthalic acid, naphthalene-2,6-dicarboxylic acid, malonic acid and mesaconic acid; and the like, as well as anhydrides thereof and lower alkyl esters thereof.

Examples of the tri- or more-valent carboxylic acid include, for example, 1,2,4-benzenetricarboxylic acid, 1,2,5-benzenetricarboxylic acid, 1,2,4-naphthalenetricarboxylic acid, anhydrides thereof, and lower alkyl esters thereof. These may be used solely or as a combination of two or more kinds.

Examples of the multivalent alcohol component include divalent multivalent alcohols such as alkylene (having 2 to 4 carbon atoms) oxide adducts of bisphenol A (average addition mol number of from 1.5 to 6) such as polyoxypropylene(2.2)-2,2-bis(4-hydroxyphenyl)propane and polyoxyethylene (2.2)-2,2-bis(4-hydroxyphenyl)propane; ethylene glycol; propylene glycol; neopentylglycol; 1,4-butanediol; 1,3-butanediol; and 1,6-hexanediol.

Examples of the tri- or more valent multivalent alcohol include sorbitol, pentaerythritol, glycerol, trimethylol propane, and the like.

In embodiments, a resin having a softening temperature of from about 90° C. to about 150° C. may be used as the binder resin employed in the transparent toner. In embodiments, a resin having a glass transition temperature of about 55° C. to about 75° C. may be used as the binder resin employed in the transparent toner. In embodiments, a resin having a number average molecular weight of from about 2000 to about 10000 may be used as the binder resin employed in the transparent toner. In embodiments, a resin having a weight average molecular weight of from about 8000 to 1 about 150000 may be used as the binder resin employed in the transparent toner. In embodiments, a resin having an acid value of from about 5 mg KOH/g to about 30 mg KOH/g may be used as the binder resin employed in the transparent toner. In embodiments, a resin having a hydroxyl group value of from about 5 mg KOH/g to about 40 mg KOH/g may be used as the binder resin employed in the transparent toner.

The production method of the polyester resin is not limited, and the polyester may be produced by a common polyester polymerization method including reacting an acid component and an alcohol component, such as direct polycondensation and transesterification. The production method may be selected according to the kind of monomers.

The polyester resin may be produced by subjecting the multivalent alcohol and multivalent carboxylic acid with condensation reaction according to a conventional method. For example, the polyester resin may be produced by charging the multivalent alcohol and multivalent carboxylic acid, and a catalyst where necessary, into a reaction vessel equipped with a thermometer, a stirrer and a falling condenser, heating the mixture at from 150° C. to 250° C. under inactive gas (nitrogen gas or the like), continuously removing the by-products (low molecular weight compounds) outside of the reaction system, quenching reaction at the timepoint where the acid value reaches a desired value, cooling, and collecting the objective reaction product.

The toner of the exemplary embodiment of the invention may contain one or more charge controlling agents for adjusting charge as an internal additive besides the binder resin, the colorant such as carbon black, and the release agent. Further, a petrolatum resin may be incorporated in order to satisfy the milling property and heat preserving property of the toner. The petroratum resin is synthesized by using diolefins and monoolefins as raw materials, which are included in decomposed oil distillate that is produced as a by-product from an ethylene plant for producing ethylene, propylene, and the like, by steam cracking of petrolatums.

The transparent toner according to the exemplary embodiment of the invention is a toner used for forming a transparent toner image that is formed together with a color toner image. The "transparent toner" means a white-color toner having a content of the colorant such as a dye or a pigment of 0.01% by mass or less.

The transparent toner image may be formed the transparent toner image is formed on the recording medium (transfer-receiving body) at the portion where the color toner image is absent, and is formed on the color toner image at the portion where the color toner image is present. Alternatively, the transparent toner image may be formed only on the color toner image.

Examples of the method for producing the transparent toner of the exemplary embodiments (hereinafter, may also be referred to as a "toner according to the exemplary embodiment of the invention") include dry production methods such as kneading or pulverization, and wet production methods such as suspension polymerization or emulsion aggregation method. Among these, an emulsion aggregation method, which may be advantageous in precisely controlling the toner shape, may be preferable from the viewpoints that the toner shape may be controlled from an irregular shape to a spherical shape by selecting the heating temperature conditions according to necessity.

Emulsion aggregation method is a method for obtaining toner particles by preparing a resin dispersion liquid by emulsion polymerization or emulsification and also preparing a dispersion liquid by dispersing a release agent dispersion liquid by dispersing a release agent in a solvent, mixing these dispersion liquids to form aggregation particles having a size corresponding to a toner particle size, and coalescing the aggregation particles by heating to provide toner particles.

The emulsion aggregation method, which is one of methods for preparing the toner of the exemplary embodiment of the invention, is further explained in detail.

The emulsion aggregation method includes aggregating, adhering, and coalescing, each of which are explained in detail.

Aggregating

In the aggregating, a mixed dispersion liquid is initially prepared by mixing a dispersion liquid of a first binder resin, and if necessary, a dispersion liquid of the release agent and/or other components, adding an aggregating agent to the mixture, and heating the mixture at a temperature which is lower than the melting temperature of the first binder resin to form aggregation particles (core aggregation particles) in which particles including various components have been aggregated. Alternatively, coalesced particles (core coalesced particles) may be formed by performing aggregating and coalescing at the same time by heating the mixture at a temperature higher than glass transition temperature of the first binder resin.

The aggregation particles are formed by adding an aggregating agent under stirring in a revolution shear-type homogenizer at room temperature (25° C.). Examples of the aggregating agent used for the aggregating include a surfactant having a reverse polarity to that of the surfactants used as a dispersing agent for various dispersion liquids.

Adhering

In the adhering, a coating layer is formed by adhering resin particles formed from a second binder resin to the surface of the core particles (core aggregation particles or core coalesced particles) containing the first binder resin that are formed in the aggregation step (hereinafter, the aggregation particles having coating layers on the surfaces of the core particles are referred to as "adhered resin-aggregation particles"). The coating layer corresponds to the shell layer of the toner of the exemplary embodiment of the invention that is formed by the fusing described below.

The coating layer may be formed by adding a dispersion liquid of the second resin particles to the dispersion liquid in which the core particles have been formed in the aggregating. When necessary, other components may be additionally incorporated herein at the same time.

The second resin particles are adhered to the surfaces of the core particles to form the adhered resin-aggregation particles, and the thus-obtained adhered resin-aggregation particles are fused with heat in the fusing described below, whereby the resin particles formed from the second binder resin included in the coating layers of the surfaces of the core particles are melted to form the shell layers. Accordingly, exposure on the surface of the toner of components such as the release agent included in the core layers disposed at an inner side of the shell layers may be effectively prevented.

The method for addition and mixing of the dispersion liquid of the second resin particles in the adhering is not specifically limited, and may be performed, for example, in a gradual and continuous manner or in a stepwise manner with numbers of stages. By such addition and mixing of the dispersion liquid of the second resin particles, generation of microparticles may be suppressed and the particle size distribution of the obtained toner may be made narrower.

Fusing

In the fusing, the adhered resin-aggregation particles obtained in the adhering are fused by application of heat. The fusing may be performed at the temperature higher than the glass transition temperature of the first binder resin or of the second binder resin, whichever is higher. When the heating temperature is high, short time is sufficient for fusing, whereas long time is required when the heating temperature is low. Namely, the time for fusing may not be flatly defined since it depends on the heating temperature, but is generally from 30 minutes to 10 hours.

Alternatively, the particles formed of the second binder resin and adhered to the surfaces of the core coalesced particles may be fused by applying mechanical stress using a Henschel mixer or the like to the adhered resin-aggregation particles that are obtained by adhering the particles formed from a second binder resin to the surfaces of the core coalesced particles, after completion of washing/drying mentioned below.

Washing/Drying

The coalesced particles obtained by the fusing are subjected to solid-liquid separation such as filtration, washing and drying. In this way, a toner containing no external additives is obtained.

A method for the solid-liquid separation is not specifically limited. In embodiments, it may be performed by aspiration filtration, pressure filtration, or the like, in view of productivity. In embodiments, substitution washing with ion exchanged water in the washing may be performed in view of charging property. A method for the drying may be selected according to purposes and may be any method such as general oscillation-type fluidizing drying method, spray drying method, freeze drying method or flash jet method. The moisture ratio of the particles of the toner after the drying may be preferably adjusted to 1.0% by weight or less, more preferably adjusted to 0.5% by weight or less.

Preparations of the dispersion liquid of the binder resin and the dispersion liquid of the release agent are explained below.

The dispersion liquid of the binder resin may be prepared by any known emulsification methods. Among them, phase transition emulsification method is effective since a narrower particle size distribution may be obtained and the volume average particle size may be readily adjusted to the range of from 0.08 nm to 0.40 nm.

In the phase transition emulsification method, a resin is dissolved in an organic solvent that dissolves resins and a single or mixed solvent of amphoteric organic solvents to form an oil phase. A small amount of basic compound is added dropwise to the oil phase while the oil phase is stirring, and water is further added dropwise in small portions while the oil phase is stirring, whereby water drops are taken into the oil phase. When the amount of the dropped water exceeds a certain amount, the oil phase and water phase are inverted and the oil phase turns into oil drops. Removing the solvents is then performed by reducing the pressure to give an aqueous dispersion liquid.

The amphoteric organic solvent refers to a solvent having a solubility in water at 20° C. of at least 5 g/L or more, preferably 10 g/L or more. When the solubility is less than 5 g/L, the effect for accelerating the treatment for making aqueous may be poor and that the aqueous dispersion obtained may have a poor storage stability. Examples of the organic solvent may include alcohols such as ethanol, n-propanol, isopropanol, n-butanol, isobutanol, sec-butanol, tert-butanol, n-amyl alcohol, isoamyl alcohol, sec-amyl alcohol, tert-amyl alcohol, 1-ethyl-1-propanol, 2-methyl-1-butanol, n-hexanol and cyclohexanol; ketones such as methyl ethyl ketone, methyl isobutyl ketone, ethyl butyl ketone, cyclohexanone and isophorone; ethers such as tetrahydrofuran and dioxane; esters such as ethyl acetate, n-propyl acetate, isopropyl acetate, n-butyl acetate, isobutyl acetate, sec-butyl acetate, 3-methoxybutyl acetate, methyl propionate, ethyl propionate, diethyl carbonate and dimethyl carbonate; glycol derivatives such as ethylene glycol, ethylene glycol monomethyl ether, ethylene glycol monoethyl ether, ethylene glycol monopropyl ether, ethylene glycol monobutyl ether, ethylene glycol ethyl ether acetate, diethylene glycol, diethylene glycol monomethyl ether, diethylene glycol monoethyl ether, diethylene glycol monopropyl ether, diethylene glycol monobutyl ether, diethylene glycol ethyl ether acetate, propylene glycol, propylene glycol monomethyl ether, propylene glycol monopropyl ether, propylene glycol monobutyl ether, propylene glycol methyl ether acetate and dipropylene glycol monobutyl ether, as well as 3-methoxy-3-methylbutanol, 3-methoxybutanol, acetonitrile, dimethylformamide, dimethylacetamide, diacetone alcohol, ethyl acetoacetate, and the like. These solvents may be used solely or as a mixture of two or more kinds.

Explanations regarding the basic compound are given below.

The polyester resin is neutralized by a basic compound when it is dispersed in an aqueous medium. Neutralization of polyester resin with carboxyl groups may be an impetus for aqueous condition, and aggregation between the particles may be prevented by electric repelling force generated among carboxyl anions obtained. Examples of the basic compound include ammonia, organic amine compounds having a boiling temperature of 250° C. or less, and the like. Examples of the organic amine compound may include triethylamine, N,N-diethylethanolamine, N,N-dimethylethanolamine, aminoethanolamine, N-methyl-N,N-diethanolamine, isopropylamine, iminobispropylamine, ethylamine, diethylamine, 3-ethoxypropylamine, 3-diethylaminopropylamine, sec-butylamine, propylamine, methylaminopropylamine, dimethylaminopropylamine, methyliminobispropylamine, 3-methoxypropylamine, monoethanolamine, diethanolamine, triethanolamine, morpholine, N-methylmorpholine, N-ethylmorpholine, and the like. The basic compound may be preferably added by an amount that may neutralize at least a part of carboxyl groups in the polyester resin, that is, by from 0.2 to 9.0-fold equivalent amount, and more preferably by from 0.6 to 2.0-fold equivalent amount, with respect to the carboxyl groups. Where the amount is less than 0.2-fold equivalent amount, the effect of addition of the basic compound is not observed. Where the amount exceeds 9.0-fold equivalent amount, the particle size distribution becomes broad and a fine dispersion liquid may not be obtained, which is likely due to excess increase of the hydrophilicity of the oil phase.

The dispersion liquid of the release agent may be formed by dispersing at least a release agent. The release agent may be dispersed by any known methods, and media type dispersing apparatuses such as a revolution shear-type homogenizer, a ball mill, a sand mill or an attritor, a high pressure counter collision dispersing apparatus, and the like may be used. The dispersion liquid of the release agent may be prepared by dispersing the release agent in an aqueous solvent using ionic surfactant having polarity and using the homogenizer. In the exemplary embodiment of the invention, the release agent may be used solely by one kind or as a combination of two or more kinds. The average particle size of the release agent particles is preferably at most 1 μm (i.e., 1 μm or less), and more preferably from 0.01 μm to 1 μm.

The combination of the resin for the resin particles and the release agent is not specifically limited and may be suitably selected according to the purpose.

In the exemplary embodiment of the invention, according to the purpose, other components (particles) such as internal additives, charge controlling agents, inorganic particles, organic particles, lubricating agents and polishing agents may be dispersed into at least either of the dispersion liquid of the binder resin and the dispersion liquid of the release agent. In this case, the other components (particles) may be dispersed into at least either of the dispersion liquid of the binder resin and the dispersion liquid of the release agent, or may be dispersed by mixing a dispersion liquid of the other components with a mixture liquid of the dispersion liquid of the binder resin and the dispersion liquid of the release agent.

Examples of the dispersion medium used for the dispersion liquid of the binder resin, the dispersion liquid of the release agent and other components include aqueous media and the like. Examples of the aqueous medium include waters such as distilled water or ion exchanged water, and alcohols. These may be used solely by one kind or as a combination of two or more kinds. Examples of the combination include distilled water and ion exchanged water. A surfactant may be added to the dispersions in view of the stability of each dispersed resin particles, release agent particles and the like in the aqueous medium, and thus of the preserving property of the dispersion liquids, as well as in view of the stability of the aggregation particles in the aggregating.

The volume average primary particle size of the thus-obtained particles dispersion liquid may be measured, for example, using a laser diffraction-type particle size distribution measurement device (trade name: LA-700, manufactured by Horiba Ltd.). In the measurement method, a sample in the form of a dispersion liquid is adjusted so that the solid content becomes about 2 g, and ion exchanged water is added to adjust the amount of the sample to about 40 ml. The mixture is put into a cell to a suitable concentration. After about 2 minutes, measurement is initiated at the time when the concentration in the cell becomes almost constant. The volume average primary particle sizes obtained for every channel are accumulated from the lower volume average primary particle sizes, and the size at the accumulation of 50% is determined to as a volume average primary particle size.

The volume average particle size of the toner used in the exemplary embodiment is preferably from about 3 μm to about 9 μm, more preferably from about 3 μm to about 8 μm. When the particle size is less than about 3 μm, development property of the toner may be deteriorated, and when the particle size exceeds about 9 μm, resolution of the image may be reduced.

The toner of the exemplary embodiment may have a volume average particle size distribution index GSDv of about 1.30 or less.

Where the volume distribution index GSDv exceeds about 1.30, the resolution of the image may be decreased.

In the exemplary embodiment, the values of the particle size and the volume average particle size distribution index GSDv of the toner are measured and calculated as follows. First, based on the particle size distribution data of the toner obtained by using a measuring instrument such as a COULTER MULTISIZER II (trade name, manufactured by Beckman-Coulter, Inc.), the volume of toner particles in each of partitioned particle ranges (channels) are obtained. These are then plotted starting from the smallest size to give a cumulative distribution curve, and the particle diameter at a cumulative point of 16% is defined as volume-average particle diameter D16v. Similarly, the particle diameter at a cumulative point of 50% is defined as volume-average particle diameter D50v, and the particle diameter at a cumulative point of 84% is defined as volume-average particle diameter D84v. The volume average particle size distribution index (GSDv) may be calculated from these values by using an equation D84v/D16v.

The shape factor SF1, namely, {(the absolute maximum length of the diameter of the toner)$^2$/the projection area of the toner}×(π/4)×100, of the toner of the exemplary embodiment is preferably in the range of from 110 to 160. The shape factor SF1 may be more preferably in the range of from 125 to 140. The value of the shape factor SF1 represents the roundness of the toner, and the value is 100 where the toner represents a perfect circle and increases as the shape of the toner becomes irregular. Further, the values required for calculation using the shape factor SF1, i.e., the absolute maximum length of the toner diameter and the projection area of the toner, are obtained by taking an image of the toner particles enlarged by 500-fold magnification using an optical microscope (trade name: MICROPHOTO-FXA, manufactured by Nikon Corporation) and subjecting the obtained information of the image to image analysis by introducing the information into an image analysis device (e.g., trade name: LUZEX III, manufactured by Nireco Corporation) via an interface. The shape factor SF1 average value is calculated based on the data obtained by measuring 1000 toner particles that are randomly sampled.

When the shape factor SF1 is less than 110, residual toner may be generally generated in transferring during image formation and removal of the residual toner may be necessitated, whereas the cleaning property during the cleaning of the residual toner using a blade or the like tends to be deteriorated, which may sometimes result in image defects. On the other hand, when the shape factor SF1 exceeds 160, the toner may be broken by collision with a carrier in a developing device where the toner is used as a developing agent. As a result, fine powder may increase, whereby the surface of the photoreceptor and the like are contaminated by the release agent component exposed on the toner surface, which may deteriorate charging property and may cause fog due to the fine powder.

Inorganic particles such as silica, alumina, titania or calcium carbonate, and resin particles such as vinyl resins, polyesters or silicones may be added, as a fluidity auxiliary agent or a cleaning auxiliary agent, to the surface of the toner used in the exemplary embodiment of the invention by shearing in dry state for the purpose of providing fluidity property or improvement of cleaning property.

Examples of the inorganic oxide particles to be added to the toner may include particles of $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$ (n is an integer of 1 to 6), $Al_2O_3.2SiO_2$, $CaCO_3$, $MgCO_3$, $BaSO_4$, $MgSO_4$, and the like, of which silica particles and titania particles are specifically preferable due to higher whiteness thereof The surfaces of the inorganic oxide particles may be subjected to hydrophobilization treatment in advance. The hydrophobilization treatment may contribute to improve the powder fluidity property, environment dependency of charging, and resistance to carrier contamination of the toner.

The hydrophobilization treatment may be performed by immersing the inorganic oxide particles in an agent for hydrophobilization treatment. Examples of the agent for hydrophobilization treatment include, but are not specifically limited to, silane coupling agents, silicone oils, titanate coupling agents, and aluminum coupling agents. These may be used solely by one kind or as a combination of two or more kinds. Among these, silane coupling agents are preferable.

Examples of the silane coupling agent include chlorosilanes, alkoxysilanes, silazanes and specific silylating agents. Specific examples thereof include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltriethoxysilane, decyltrimethoxysilane, hexamethyldisilazane, N,O-(bistrimethylsilyl)acetamide, N,N-(trimethylsilyl)urea, tert-butyldimethylchlorosilane, vinyltrichlorosilane, vinyltrimethoxysilane, vinyltriethoxysilane, γ-methacyloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane, γ-chloropropyltrimethoxysilane, and the like. Although the amount of the hydrophobilization treatment agent varies depending on the kind and the like of the inorganic oxide particles and may not be flatly defined, it is generally from about 1 to 50 parts by weight, with respect to 100 parts by weight of the inorganic oxide particles.

When the developer is prepared as two-component developer, the mixing ratio of the toner of the exemplary embodiment of the invention to the carrier of the exemplary embodiment of the invention (toner:carrier) in terms of weight is in the range of from about 1:100 to about 30:100, and preferably in the range of from about 3:100 to about 20:100.

In the case where the developer for developing an electrostatic latent image development according to the exemplary embodiment of the invention contains a transparent toner and a carrier for electrostatic latent image development, the tinge of the binder resin contained in the transparent toner may be controlled. Accordingly, the toner image obtained from the subject developer for developing an electrostatic latent image development can suppress the color irregularities occurring due to the color tone of the resin.

Developer Cartridge for Developing an Electrostatic Latent Image Development, Process Cartridge and Image Formation Apparatus The developer cartridge for developing an electrostatic latent image development of the exemplary embodiment of the invention (hereinafter, may be simply referred to as "cartridge") will be explained. The cartridge of the exemplary embodiment of the invention stores at least the developer of the exemplary embodiment of the invention. The developer cartridge supplies the developer of the exemplary embodiment of the invention to a developing unit of an image formation apparatus having at least an electrostatic latent image holder and the developing unit which develops an electrostatic latent image formed on a surface of the electrostatic latent image holder to form a toner image.

Therefore, when the cartridge of the exemplary embodiment of the invention containing the developer of the exemplary embodiment of the invention is used in an image formation apparatus having a configuration capable of attaching and detaching a cartridge, a toner image which can control the color irregularities occurring due to the color tone of the resin, may be obtained.

The process cartridge of the exemplary embodiment of the invention stores the developer of the exemplary embodiment of the invention and equipped with at least one selected from the group consisting of: an electrostatic latent image holder; a charging unit that charges a surface of the electrostatic latent image holder; a developing unit that develops the electrostatic latent image formed on the surface of the electrostatic latent image holder with the developer to form a toner image; and a cleaning unit that removes residual toner on the surface of the electrostatic latent image holder.

The image formation apparatus of the exemplary embodiment of the invention has at least a color toner image-forming unit, a transparent toner image-forming unit and a fixing unit, the color toner image-forming unit having at least: a first electrostatic latent image holder; a first charging unit which charges the surface of the first electrostatic latent image holder; a first electrostatic latent image forming unit that forms an electrostatic latent image on the surface of the first electrostatic latent image holder charged by the first charging unit; a first developing unit that develops the first electrostatic latent image formed on the surface of the first electrostatic latent image holder with a developer containing at least a color toner to form a color toner image; and a first transferring unit which transfers the color toner image formed on the surface of the first electrostatic latent image holder to a surface of a recording medium, the transparent toner image-forming unit having at least: a second electrostatic latent image holder; a second charging unit which charges the surface of the second electrostatic latent image holder; a second electrostatic latent image forming unit that forms an electrostatic latent image on the surface of the second electrostatic latent image holder charged by the second charging unit; a second developing unit that develops the second electrostatic latent image formed on the surface of the second electrostatic latent image holder with the developer of the exemplary embodiment of the invention containing at least the transparent toner to form a transparent toner image; and a second transferring unit which transfers the transparent toner image formed on the surface of the second electrostatic latent image holder to the surface of the recording medium, and the fixing unit fixing the transferred color toner image and the transferred transparent toner image on the surface of the recording medium.

The image formation apparatus of the exemplary embodiment of the invention will be described below, although the exemplary embodiments are not intended to be limited to the following configuration.

When the image formation apparatus has a primary transfer unit which transfers a toner image formed on an electrostatic latent image holding body to an intermediate transfer body and a secondary transfer unit which transfers the toner image on the intermediate transfer body to a recording medium, the image formation apparatus prefrably has an intermediate transfer belt as the secondary transfer unit in view of obtaining high quality transferred image.

The image formation apparatus having the such configuration may be, for example, a conventional monocolor image formation apparatus which holds a monochromatic toner in its developing unit, a color image formation apparatus which sequentially repeats primary transfer of a toner image retained on an electrostatic latent image holding body such as a photoreceptor drum to an intermediate transfer body, or a tandem type color image formation apparatus in which plural electrostatic latent image holding bodies respectively equipped with a developing unit for each color are arranged in series on an intermediate transfer body.

FIG. 1 is a schematic view illustrating an example of an image formation apparatus according to the exemplary embodiment of the invention.

The image formation apparatus according to the exemplary embodiment has a tandem type configuration having plural photoreceptors, that is, plural image forming units (image forming means), as the electrostatic latent image holding body.

In the image formation apparatus according to the exemplary embodiment, as shown in FIG. 1, four image forming units 50Y, 50M, 50C and 50K which respectively form an image of each of the colors of yellow, magenta, cyan and black, and an image forming unit 50T which forms a transparent image, are disposed in parallel (in tandem) at a certain distance.

The image forming units 50Y, 50M, 50C, 50K and 50T have a basically same configuration, except for the color of the toner in the developer contained in the unit. Thus, the image forming unit 50Y for yellow color will be hereinafter described as a representative example.

The yellow image forming unit 50Y includes a photoreceptor 11Y as an electrostatic latent image holding body. This photoreceptor 11Y is rotary driven at a predetermined process speed by a driving unit that is not shown in the FIGURE, along the direction of the arrow A shown in the FIGURE. As for photoreceptor 11Y, for example, an organic photoreceptor that is sensitive in the infrared region is used.

The fixation speed of the image formation apparatus of the exemplary embodiment is preferably in the range of from about 240 mm/s to about 600 mm/s, and more preferably from about 300 mm/s to about 500 mm/s.

The image formation apparatus of the exemplary embodiment can produce a stable image which has high glossiness and excellent color reproducibility, and does not generate toner blisters, without impairing the strength of the fixed image, even at the fixation speed of about 240 mm/s to about 600 mm/s. Here, the "fixation speed" means the speed at which a recording material runs within a fixing unit.

In the upper part of the photoreceptor 11Y, a charging roll 18Y (charging unit) is provided. A predetermined voltage is applied to the charging roll 18Y by a power supply, which is not shown in the FIGURE, and the surface of the photoreceptor 11Y is charged to a predetermined potential.

The charging rolls 18M, 18C and 18K, and the photoreceptors 11M, 11C and 11K are also respectively subjected to charging similar to the charging of the photoreceptor 11Y.

In the vicinity of the photoreceptor 11Y, an exposure device 19Y (electrostatic latent image forming unit), which forms an electrostatic latent image by performing image exposure on the surface of the photoreceptor 11Y, is disposed on the downstream side to the charging roll 18Y in the direction of rotation of the photoreceptor 11Y. An LED array, which may be made in a smaller size, is used herein as the exposure device 19Y in consideration of saving space, although the electrostatic latent image forming unit is not intended to be limited to this, and other laser beams may also be used.

In the vicinity of the photoreceptor 11Y, a developing device 20Y (developing unit) for yellow color is disposed on the downstream side to the exposure device 19Y in the direction of rotation of the photoreceptor 11Y. An electrostatic latent image formed on the surface of the photoreceptor 11Y is visualized by the yellow-color toner, and thereby a toner image is formed on the surface of the photoreceptor 11Y.

Below the photoreceptor 11Y, an intermediate transfer belt 33 (primary transfer unit), which performs primary transfer of a toner image formed on the surface of the photoreceptor 11Y, is disposed so as to extend over below five photoreceptors 11T, 11Y, 11M, 11C and 11K. This intermediate transfer belt 33 is pressed to the surface of the photoreceptor 11Y by a primary transfer roll 17Y. The intermediate transfer belt 33 is stretched by three rolls of a driving roll 12, a supporting roll 13 and a bias roll 14, and is made to move around in the direction of the arrow B at the same speed of movement of the process speed of the photoreceptor 11Y.

A transparent toner image is primary transferred onto the surface of the intermediate transfer belt 33 prior to the primary transfer of the toner image of yellow color. Subsequently, the toner image of yellow color is primary transferred thereon as described above. Then, a toner image for magenta color, a toner image for cyan color, and a toner image for black color are sequentially primary transferred and disposed thereon.

In the vicinity of the photoreceptor 11Y, a cleaning device 15Y, which cleans any toner remaining on the surface of the photoreceptor 11Y or any retransferred toner, is disposed on the downstream side to the primary transfer roll 17Y in the direction of rotation of the photoreceptor (direction of the arrow A). A cleaning blade in the cleaning device 15Y is mounted so as to be pressed to contact with the surface of the photoreceptor 11Y in the counter direction.

A secondary transfer roll 34 (secondary transfer unit) is pressed to contact with the bias roll 14, which stretches the intermediate transfer belt 33, with the intermediate transfer belt 33 interposed between the rolls. The toner image primary transferred to and disposed on the surface of the intermediate transfer belt 33 is electrostatically transferred to the surface of a recording paper (transfer-receiving body) which is supplied from a paper cassette, which is not shown in the FIGURE, at the press-contacting part of the bias roll 14 and the secondary transfer roll 34. At this time, the toner image transferred and disposed on the intermediate transfer belt 33 has the transparent toner image at the bottom (location to contact with the intermediate transfer belt 33). Therefore, the toner image transferred to the surface of the recording paper has the transparent toner image at the top.

A fixing device 35 (fixing unit), which fixes the toner image, that has been transferred on a recording paper to the surface of the recording paper in a state of deposition of plural color toner images, by heat and pressure to obtain a permanent image, is disposed below the supporting roll 13 of the intermediate transfer belt 33.

Examples of the fixing unit which may be used in the exemplary embodiment of the invention include: a fixing belt which has a belt shape and uses a low surface energy material, typical examples of which include a fluoro component and a silicone resin, at its surface; and a fixing device which has a cylindrical roll shape and uses a low surface energy material, typical examples of which include a fluoro component and a silicone resin, at its surface.

Next, the operation of image forming units 50Y, 50C and 50K which have the configuration explained above and respectively form images of yellow, magenta, cyan or black colors, will be described. Since the operation of the respective image forming units 50Y, 50M, 50C and 50K is similar, the operation of the image forming unit for yellow color 50Y will be described as a representative example.

In the developing unit 50Y for yellow color image, the photoreceptor 11Y rotates in the direction of the arrow A at a predetermined process speed. The surface of the photoreceptor 11Y is negatively charged to a predetermined potential by electric discharge occurring at the microscopic gap between the charging roll 18Y and the photoreceptor 11Y as a result of application of a predetermined voltage to the charging roll 18Y by a power supply, which is not shown in the charge, or by injection of charges. Subsequently, imagewise exposure is performed at the surface of the photoreceptor 11Y by an exposure device 19Y to form an electrostatic latent image corresponding to the image information. Then, the electrostatic latent image formed at the surface of the photoreceptor 11Y is subjected to reversal development with a toner negatively charged by a developing device 20Y, and is thus visualized as a toner image on the surface of the photoreceptor 11Y.

The toner image on the surface of the photoreceptor 11Y is primary transferred to the surface of the intermediate transfer belt 33 by the primary transfer roll 17Y. After the primary transfer, the photoreceptor 11Y is cleaned as the toner remaining on the surface or the like is scraped off by the cleaning blade of the cleaning device 15Y, and the photoreceptor is prepared for the image forming process which follows.

This operation is carried out by each of the image forming units 50T, 50Y, 50M, 50C and 50K, and the toner images visualized at the surface of the respective photoreceptors 11T, 11Y, 11M, 11C and 11K and sequentially multi-transferred to the surface of the intermediate transfer belt 33. When image formation is carried out in the color mode, the toner images of the respective colors are multi-transferred in the order of transparent, yellow, magenta, cyan and black. When a bicolor mode or a tricolor mode, only the toner images of needed colors are single- or multi-transferred in this order. The toner image which has been single-transferred or multi-transferred to the surface of the intermediate belt 33 is secondary transferred by a secondary transfer roll 34 to the surface of a recording paper which has been conveyed from a paper cassette, which is not shown in the FIGURE, and is fixed as the toner image is heated and pressed by the fixing unit 35. After the secondary transfer, any toner remaining on the surface of the intermediate transfer belt 33 is removed by a belt cleaner 16 composed of a cleaning blade for cleaning the intermediate transfer belt 33.

The tandem configuration is provided with the cleaning device 15 and the belt cleaner 16 in the exemplary embodiment of the invention.

EXAMPLES

Hereinafter, the exemplary embodiment is explained with referring to the Examples, although the invention is not limited thereto. In the following Examples, "part" refers to "parts by weight" unless specifically mentioned.

Preparation of Resin Particle Dispersion (1)

In a reaction vessel equipped with a stirrer, a thermometer, a condenser and a nitrogen gas inlet tube, 63 parts of terephthalic acid, 33 parts of dodecenylsuccinic anhydride and 5 parts of trimellitic anhydride as acid components, and 10 parts of a 2-mol adduct of bisphenol A ethylene oxide and 90 parts of a 2-mol adduct of bisphenol A propylene oxide as alcohol components are introduced. The reaction vessel is purged with dry nitrogen gas, and then 0.32 parts of dibutyltin butoxide is introduced. The content of the reaction vessel is allowed to react under stirring for 4 hours at 210° C. under a nitrogen gas stream, and is further allowed to react under stirring for 6.0 hours at an raised temperature of 240° C. After the reaction, the pressure inside the vessel is reduced down to 10.0 mmHg, and under the reduced pressure, the content is allowed to react under stirring for about 0.5 hours, to obtain a transparent, pale yellow-colored polyester resin. The glass transition temperature (Tg) thereof is 57° C., and the weight average molecular weight (Mw) thereof is 20000.

50 parts of the polyester resin is dissolved in 250 parts of ethyl acetate, and a liquid prepared by dissolving 2 parts of an anionic surfactant DOWFAX (trade name, manufactured by Dow Chemicals), in 300 parts of ion exchanged water, is added thereto. The solution is stirred for 20 minutes at 8,000 rpm using a homogenizer (trade name: ULTRA-TURRAX T50, manufactured by IKA Co., Ltd.), and ethyl acetate is distilled off to obtain a polyester resin dispersion. Moisture is removed from the dispersion liquid in an evaporator, to make the solids concentration 42% by weight or more, and deionized water is added to a resin particle dispersion (1) having a solids concentration of 40% by weight.

Preparation of Resin Particle Dispersion (2)

260 parts of styrene, 140 parts of n-butyl acrylate, 8 parts of acrylic acid, and 10 parts of dodecanethiol are mixed and dissolved. The dissolved mixture is emulsion polymerized in a flask containing 10 parts of an anionic surfactant (trade name: NEOGEN SC, manufactured by Daiichi Kogyo Seiyaku Co., Ltd.) dissolved in 550 parts of ion exchanged water. While the content in the flask is slowly mixed for 10 minutes, 50 parts of ion exchanged water containing 4 parts of ammonium persulfate dissolved therein is introduced into the flask. After nitrogen purging, while the content in the flask is stirred, the content is heated in an oil bath to reach 70° C., and emulsion polymerization is continued under the same conditions for 5 hours. As a result, a resin particle dispersion (2) in which resin particles having a particle size of 200 nm, a glass transition temperature (Tg) of 52° C. and a weight average molecular weight (Mw) of 22,000 are dispersed, is obtained. The solids concentration of this dispersion is 40% by weight.

Preparation of Release Agent Dispersion

| | |
|---|---|
| Paraffin wax (trade name: HNP0190, manufactured by Nippon Seiro Co., Ltd., melting temperature 85° C.) | 100 parts |
| Cationic surfactant (trade name: SANISOL B50, manufactured by Kao Corp.) | 5 parts |
| Ion exchanged water | 240 parts |

These components are dispersed in a round-shaped flask made of stainless steel for 10 minutes using a homogenizer (trade name: ULTRA-TURRAX T50, described above), and then subjected to dispersing treatment with a pressure ejection type homogenizer to prepare a release agent dispersion in which release agent particles having an average particle size of 350 nm are dispersed.

Preparation of Transparent Toner (1)

| | |
|---|---|
| Resin particle dispersion (1) prepared as described above | 264 parts |
| Release agent dispersion prepared as described above | 40 parts |
| Polyaluminum chloride (trade name: PAC100W, manufactured by Asada Chemical Co., Ltd.) | 1.8 parts |
| Ion exchanged water | 600 parts |

These components are mixed in a round-shaped stainless steel flask using a homogenizer (trade name: ULTRA-TURRAX T50, described above) and dispersed, and then the dispersion is heated to 52° C. in an oil bath for heating while the content inside the flask is stirred. The resultant is maintained at 52° C. for 120 minutes, and then it is confirmed that aggregate particles having a volume average particle size (D50v) of 4.8 μm are generated. Subsequently, to the dispersion containing these aggregate particles, 32 parts by weight of the resin particle dispersion is added, and then the temperature of the oil bath for heating is increased to 53° C., at which the mixture is maintained for 30 minutes. 1 N sodium hydroxide is added to this dispersion containing aggregate particles to adjust the pH of the system to 5.0, and then the stainless steel flask is sealed. While stirring is continued using a magnetic seal, the content of the flask is heated to 95° C., and is maintained for 2 hours at pH 5.0. After cooling, these toner mother particles are separated by filtration, and are washed four times with ion exchanged water and freeze-dried, to obtain a transparent toner (1). The volume average particle size (D50v) of the toner is 5.5 μm, and the shape factor is 122.

Preparation of Transparent Toner A for External Addition 1.3 parts by weight of silicone oil-treated silicon oxide particles (trade name: RY50, manufactured by Nippon Aerosil Co., Ltd.) having an average particle size of 40 nm is mixed into 100 parts by weight of the transparent toner (1) with a sample mill so as to provide a transparent toner A for external addition.

Preparation of Transparent Toner B for External Addition

A transparent toner (2) is produced by the same method as that for the transparent toner (1) except that the resin particle dispersion (2) is used instead of the resin particle dispersion (1) used in the preparation of the transparent toner (1), and a transparent toner B for external addition is produced using the thus-formed transparent toner (2) with the same external additives and under the same external additive conditions as those used in the preparation of the transparent toner A. The volume average particle size, D50v, is 5.5 μm, and the shape factor of the transparent toner (2) is 122.

Preparation of Resin Coated Carrier 1

| | |
|---|---|
| Mn—Mg ferrite particles (volume average particle size: 35 μm, shape factor 125) | 100 parts |
| Cyclohexyl methacrylate/dimethylaminoethyl methacrylate copolymer (copolymerization ratio 80:20, Mw: 60,000) | 2.5 parts |
| Copper phthalocyanine (trade name: PB15:3, manufactured by Dainichiseika Color & Chemicals Manufacturing Co., Ltd.) | 0.5 parts |
| Toluene | 14 parts |

The components except the ferrite particles are stirred together with glass beads (diameter: 1 mm, in the same amount as that of toluene) at 1200 rpm for 30 minutes using a sand mill manufactured by Kansai Paint Co., Ltd., to obtain a resin coating layer formation liquid. This resin coating layer formation liquid and ferrite particles are placed in a vacuum degassing type kneader, and toluene is distilled off, to thereby produce a resin coated carrier 1. The resin coated carrier 1 has the shape factor (SF1) of 125, the particle size distribution of finer powders of 1.30, and the particle size distribution of coarser powders of 1.30.

Preparation of Resin Coated Carrier 2

| | |
|---|---|
| Mn—Mg ferrite particles (volume average particle size: 35 μm, shape factor 125) | 100 parts |
| Cyclohexyl methacrylate/dimethylaminoethyl methacrylate copolymer (copolymerization ratio 50:50, Mw: 63,000) | 2.5 parts |

-continued

| | |
|---|---|
| Copper phthalocyanine (trade name: PB15:3, manufactured by Dainichiseika Color & Chemicals Manufacturing Co., Ltd.) | 0.5 parts |
| Toluene | 14 parts |

The components except the ferrite particles are stirred together with glass beads (diameter: 1 mm, in the same amount as that of toluene) at 1200 rpm for 30 minutes using a sand mill manufactured by Kansai Paint Co., Ltd., to obtain a resin coating layer formation liquid. This resin coating layer formation liquid and ferrite particles are placed in a vacuum degassing type kneader, and toluene is distilled off, to thereby produce a resin coated carrier 2. The resin coated carrier 2 has the shape factor (SF1) of 125, the particle size distribution of finer powders of 1.30, and the particle size distribution of coarser powders of 1.30.

Preparation of Resin Coated Carrier 3

| | |
|---|---|
| Mn—Mg ferrite particles (volume average particle size: 35 μm, shape factor 125) | 100 parts |
| Cyclohexyl methacrylate/dimethylaminoethyl methacrylate copolymer (copolymerization ratio 99.5:0.5, Mw: 61,000) | 2.5 parts |
| Copper phthalocyanine (trade name: PB15:3, manufactured by Dainichiseika Color & Chemicals Manufacturing Co., Ltd.) | 0.5 parts |
| Toluene | 14 parts |

The components except the ferrite particles are stirred together with glass beads (diameter: 1 mm, in the same amount as that of toluene) at 1200 rpm for 30 minutes using a sand mill manufactured by Kansai Paint Co., Ltd., to obtain a resin coating layer formation liquid. This resin coating layer formation liquid and ferrite particles are placed in a vacuum degassing type kneader, and toluene is distilled off, to thereby produce a resin coated carrier 3. The resin coated carrier 3 has the shape factor (SF1) of 125, the particle size distribution of finer powders of 1.30, and the particle size distribution of coarser powders of 1.30.

Preparation of Resin Coated Carrier 4

| | |
|---|---|
| Mn—Mg ferrite particles (volume average particle size: 35 μm, shape factor 125) | 100 parts |
| Polycyclohexyl methacrylate (Mw: 60,000) | 2.5 parts |
| Copper phthalocyanine (trade name: PB15:3, manufactured by Dainichiseika Color & Chemicals Manufacturing Co., Ltd.) | 0.5 parts |
| Toluene | 14 parts |

The components except the ferrite particles are stirred together with glass beads (diameter: 1 mm, in the same amount as that of toluene) at 1200 rpm for 30 minutes using a sand mill manufactured by Kansai Paint Co., Ltd., to obtain a resin coating layer formation liquid. This resin coating layer formation liquid and ferrite particles are placed in a vacuum degassing type kneader, and toluene is distilled off, to thereby produce a resin coated carrier 4. The resin coated carrier 4 has the shape factor (SF1) of 125, the particle size distribution of finer powders of 1.30, and the particle size distribution of coarser powders of 1.30.

Preparation of Resin Coated Carrier 5

| | |
|---|---|
| Mn—Mg ferrite particles (volume average particle size: 35 μm, shape factor 125) | 100 parts |
| Cyclohexyl methacrylate/dimethylaminoethyl methacrylate copolymer (copolymerization ratio 49:51, Mw: 61,000) | 2.5 parts |
| Copper phthalocyanine (trade name: PB15:3, manufactured by Dainichiseika Color & Chemicals Manufacturing Co., Ltd.) | 0.5 parts |
| Toluene | 14 parts |

The components except the ferrite particles are stirred together with glass beads (diameter: 1 mm, in the same amount as that of toluene) at 1200 rpm for 30 minutes using a sand mill manufactured by Kansai Paint Co., Ltd., to obtain a resin coating layer formation liquid. This resin coating layer formation liquid and ferrite particles are placed in a vacuum degassing type kneader, and toluene is distilled off, to thereby produce a resin coated carrier 5. The resin coated carrier 5 has the shape factor (SF1) of 125, the particle size distribution of finer powders of 1.30, and the particle size distribution of coarser powders of 1.30.

Preparation of Resin Coated Carrier 6

| | |
|---|---|
| Mn—Mg ferrite particles (volume average particle size: 35 μm, shape factor 125) | 100 parts |
| Cyclohexyl methacrylate/dimethylaminoethyl methacrylate copolymer (copolymerization ratio 80:205, Mw: 60,000) | 2.5 parts |
| Copper phthalocyanine (trade name: PB15:3, manufactured by Dainichiseika Color & Chemicals Manufacturing Co., Ltd.) | 0.5 parts |
| Toluene | 14 parts |

The components except the ferrite particles are stirred together with glass beads (diameter: 1 mm, in the same amount as that of toluene) at 1200 rpm for 30 minutes using a sand mill manufactured by Kansai Paint Co., Ltd., to obtain a resin coating layer formation liquid. This resin coating layer formation liquid and ferrite particles are placed in a vacuum degassing type kneader, and toluene is distilled off, to thereby produce a resin coated carrier 6. The resin coated carrier 6 has the shape factor (SF1) of 125, the particle size distribution of finer powders of 1.30, and the particle size distribution of coarser powders of 1.30.

Preparation of Resin Coated Carrier 7

| | |
|---|---|
| Mn—Mg ferrite particles (volume average particle size: 35 μm, shape factor 125) | 100 parts |
| Cyclohexyl methacrylate/dimethylaminoethyl methacrylate copolymer (copolymerization ratio 80:205, Mw: 60,000) | 2.5 parts |
| Copper phthalocyanine (trade name: PB15:3, manufactured by Dainichiseika Color & Chemicals Manufacturing Co., Ltd.) | 0.5 parts |
| Toluene | 14 parts |

The components except the ferrite particles are stirred together with glass beads (diameter: 1 mm, in the same amount as that of toluene) at 1200 rpm for 30 minutes using a sand mill manufactured by Kansai Paint Co., Ltd., to obtain a resin coating layer formation liquid. This resin coating layer formation liquid and ferrite particles are placed in a vacuum degassing type kneader, and toluene is distilled off, to thereby produce a resin coated carrier. This resin coated carrier is classified and fine particles and coarse particles are removed therefrom to produce a resin coated carrier 7. The resin coated carrier 7 has the shape factor (SF1) of 125, the particle size distribution of finer powders of 1.20, and the particle size distribution of coarser powders of 1.20.

Preparation of Resin Coated Carrier 8

A a resin coated carrier 8 is produced in the same manner as the resin coated carrier 1, except that the use of the copper phthalocyanine is herein omitted. The resin coated carrier 8 has the shape factor (SF1) of 125, the particle size distribution of finer powders of 1.30, and the particle size distribution of coarser powders of 1.30.

Example 1

Preparation of Developer 1

8 parts of the transparent toner A for external addition and 100 parts of the resin coated carrier 1 are stirred with a V type blender at 40 rpm for 20 minutes, and the mixture is screened with a sieve having a mesh size of 212 μm, to provide a developer 1.

Example 2

Preparation of Developer 2

A developer 2 is provided in the same manner as the developer 1, except that the resin coated carrier 2 is employed in place of the resin coated carrier 1.

Example 3

Preparation of Developer 3

A developer 3 is provided in the same manner as the developer 1, except that the resin coated carrier 3 is employed in place of the resin coated carrier 1.

Example 4

Preparation of Developer 4

A developer 4 is provided in the same manner as the developer 1, except that the resin coated carrier 4 is employed in place of the resin coated carrier 1.

Example 5

Preparation of Developer 5

A developer 5 is provided in the same manner as the developer 1, except that the resin coated carrier 5 is employed in place of the resin coated carrier 1.

Example 6

Preparation of Developer 6

A developer 6 is provided in the same manner as the developer 1, except that the resin coated carrier 6 is employed in place of the resin coated carrier 1.

Example 7

Preparation of Developer 7

A developer 7 is provided in the same manner as the developer 1, except that the resin coated carrier 7 is employed in place of the resin coated carrier 1.

Example 8

Preparation of Developer 8

A developer 8 is provided in the same manner as the developer 1, except that the transparent toner B is employed in place of the transparent toner A.

Comparative Example 1

Preparation of Comparative Developer 1

8 parts of the transparent toner A for external addition and 100 parts of the resin coated carrier 8 are stirred with a V type blender at 40 rpm for 20 minutes, and the mixture is screened with a sieve having a mesh size of 212 μm, to provide a developer 1.

A transparent toner image having the input concentration (Cin) of 100% is output on an A4-size paper using the developers obtained in Example 1 to Example 8 and Comparative Example 1, and the density/color evaluation and density irregularities/color irregularities evaluation are carried out by the following evaluation methods when printing of 10 sheets (initial) is completed and when printing of 10,000 sheets is completed.

The evaluation is carried out in an environment at a temperature of 23° C. and a humidity of 55% RH (relative humidity). The paper used in the evaluation is A4 paper (trade name: MILLER COAT PLATINUM PAPER, manufactured by Fuji Xerox Corp.; basis weight: 256 g/m$^2$). For the evaluating machine, a modified machine of DOCUPRINT C1616 (trade name, manufactured by Fuji Xerox Corp.) is used.

Evaluation of Density and Color

The image density (L*) and chroma C* of the images obtained when image printing of 10 sheets is completed and when image printing of 10,000 sheets is completed are measured by a spectrodensitometer (trade name: X-RITE 939, manufactured by X-Rite, Inc.). Specifically, the image density and chroma of 10 points that are randomly selected from an image are measured, and the average values of the points are determined as the density (L*) and chroma (C*) of the image. The density of the white paper part is measured, and the difference of density between the average value and the density of the white paper part is designated as "density". The results are shown in Table 1.

Evaluation of Density Irregularities and Color Irregularities

The difference between the maximum value and the minimum value of the image density (L*) and that of the chroma (C*) obtained in the evaluations of the image density and the chroma are respectively determined to provide the density irregularities. The results are shown in Table 1.

TABLE 1

| | When 10 sheets-image printing completed | | | | When 10,000 sheets-image printing completed | | | |
|---|---|---|---|---|---|---|---|---|
| | Density and Color | | Density irregularity and Color irregularity | | Density and Color | | Density irregularity and Color irregularity | |
| | L* | C* | ΔL* | ΔC* | L* | C* | ΔL* | ΔC* |
| Example 1 | 94.58 | 0.18 | 0.42 | 0.08 | 94.51 | 0.21 | 0.52 | 0.10 |
| Example 2 | 94.27 | 0.25 | 0.51 | 0.12 | 94.10 | 0.33 | 0.68 | 0.13 |
| Example 3 | 94.30 | 0.23 | 0.53 | 0.11 | 94.08 | 0.31 | 0.69 | 0.14 |
| Example 4 | 94.15 | 0.28 | 0.59 | 0.14 | 93.91 | 0.39 | 0.75 | 0.17 |
| Example 5 | 94.05 | 0.31 | 0.61 | 0.15 | 93.78 | 0.44 | 0.78 | 0.20 |
| Example 6 | 94.53 | 0.18 | 0.39 | 0.05 | 94.50 | 0.19 | 0.42 | 0.06 |
| Example 7 | 94.62 | 0.15 | 0.35 | 0.06 | 94.55 | 0.16 | 0.41 | 0.07 |
| Example 8 | 94.61 | 0.15 | 0.40 | 0.06 | 94.55 | 0.17 | 0.52 | 0.10 |
| Comparative example 1 | 92.86 | 1.60 | 1.31 | 0.30 | 90.56 | 1.91 | 1.98 | 0.53 |

From the results shown above, it is understood that the Examples which use the developers of the exemplary embodiment of the invention have smaller density differences with white paper parts, and have smaller irregularities in the image, as compared to the Comparative example. It is also understood that even if a polyester resin which originally has a pale yellow color is used, the Examples which use the developers of the exemplary embodiment of the invention can show results comparable to the case of using a styrene-acrylic resin that is less yellowish.

The foregoing description of exemplary embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its applications, thereby enabling others skilled in the art to understand the invention for various embodiments and with the various modifications as are suited to particular use contemplated. It is intended that the scope of the invention be defined by the following claims and their equivalents.

What is claimed is:

1. A developer for developing an electrostatic latent image, the developer comprising:

a transparent toner that comprises a colorant in an amount of 0.01% by mass or less; and a carrier, the carrier comprising:

a magnetic particle; and a resin coating layer that coats the surface of the magnetic particle, comprises a cyan colorant or a combination of a blue colorant and a green colorant, and has cyan color, and is present in the resin coating layer in an amount from 1% by mass to 5% by mass with respect to the total amount of the resin coating layer; and the resin coating layer comprises at least one selected from the group consisting of resin particles and conductive particles having a volume resistivity of $10^2$ Ω·cm or less at 20° C., wherein the average value of the shape factor SF1 of the carrier is in a range of from 100 to 120.

2. The developer of claim 1, wherein the resin coating layer comprises a cyan colorant.

3. The developer of claim 2, wherein the resin coating layer exhibits a main peak of transmittance in a wavelength region of from 430 nm to 550 nm.

4. The developer of claim 1, wherein the resin coating layer comprises a resin comprising a non-polar vinyl monomer as a structural unit, and the content of the resin having a non-polar vinyl monomer as a constituent unit is 50 mol % or more with respect to the total amount of the resin coating layer.

5. The developer of claim 4, wherein the non-polar vinyl monomer comprises at least one selected from the group consisting of an acrylic acid ester and a methacrylic acid ester, each having an alicyclic group on a branch.

6. The developer of claim 5, wherein the acrylic acid ester is a cyclohexyl acrylate, and the methacrylic acid ester is a cyclohexyl methacrylate.

7. The developer of claim 1, wherein the magnetic particle comprises ferrite.

8. The developer of claim 1, wherein the resin coating layer comprises the resin particles, and the average particle diameter of the resin particles is in the range of from 0.1 μm to 2 μm.

9. The developer of claim 1, wherein the particle size distribution of finer powders of the carrier and the particle size distribution of coarser powders of the carrier are both in the range of from 1.00 to 1.20.

10. The developer of claim 1, wherein the electrical resistivity of the entire of the carrier in the state of a magnetic brush under an electrical field of $10^4$ V/cm is $10^8$ Ω·cm or more.

11. The developer of claim 1, wherein the transparent toner comprises a resin having a softening temperature of from 90° C. to 150° C.

12. The developer of claim 1, wherein the transparent toner comprises a resin having a glass transition temperature of from 55° C. to 75° C.

13. The developer of claim 1, wherein the transparent toner comprises a resin having a weight average molecular weight of from 8,000 to 150,000.

14. The developer of claim 1, wherein the transparent toner has a volume average particle size distribution index GSDv of 1.30 or less.

* * * * *